US007578408B1

(12) United States Patent
Lin

(10) Patent No.: US 7,578,408 B1
(45) Date of Patent: Aug. 25, 2009

(54) PATTERNED FRAME STRUCTURE

(75) Inventor: Steven Lin, Hsichih (TW)

(73) Assignee: DECORWAY Co., Ltd., Hsichih, Taipei County (TW)

( * ) Notice: Subject to any disclaimer, the term of this patent is extended or adjusted under 35 U.S.C. 154(b) by 395 days.

(21) Appl. No.: 11/467,762

(22) Filed: Aug. 28, 2006

(51) Int. Cl.
*B65D 6/08* (2006.01)

(52) U.S. Cl. ..... 220/491

(58) Field of Classification Search ..... 220/485, 220/489–491
See application file for complete search history.

(56) References Cited

U.S. PATENT DOCUMENTS 5,267,664 A * 12/1993 Younikian ..... 220/6
2006/0185231 A1* 8/2006 Barrett ..... 47/41.11

* cited by examiner

*Primary Examiner*—Harry A Grosso
(74) *Attorney, Agent, or Firm*—Egbert Law Offices PLLC

(57) ABSTRACT

A patterned frame structure including a plurality of wire frame elements. The frame elements are made of wire shaped by press plates. The frame elements overlap each other, so that the frame elements create a basket or pad that has a bottom mesh and containment space. The frame elements have a central area and a plurality of petal-shaped portions extending therefrom.

1 Claim, 4 Drawing Sheets

PATTERNED FRAME STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a patterned frame structure, and more particularly to a frame structure for a basket or pad or decoration for screens.

2. Description of Related Art Including Information Disclosed Under 37 CFR 1.97 and 37 CFR 1.98.

The conventional basket, such as fruit basket or food basket, is woven into nets by metal wires, and the sides of the basket are framed by several pieces of net. The bottom of basket is made with a wooden base or a metal net for several pieces of net to be inserted therein or to be connected to make a basket.

The structure of the conventional basket still has disadvantages. For instance, the sides of the basket are made from several pieces of net. Therefore, perspective multilayer images are not presented, which makes the appearance of the conventional basket look dull, reducing its competitiveness.

Also, the nets can only form the sides of the basket; therefore, an extra wooden base or a bottom net is needed for the nets to connect to form the base for the basket. The extra piece increases the cost for the production of the conventional basket and adds more procedures to the assembly, which is not cost effective.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

The frame structure includes each frame 1, 2, 3, made of bent wires. The wires can also be shaped by pressing with plates. After the indentations at 101, 201, 301, are made, the frames overlap each other to form the basket 10, so that the sides of the frames 1, 2, 3, have multiple layers, as shown in FIG. 3. The basket 10 shows the multiple layers and 3D petal shaped appearance after the special arrangement of the frames 1, 2, 3. By so doing, the look and style of the basket 10 is greatly increased, as well as strengthening the competitiveness of the basket in the market.

After the frames 1, 2, 3, are overlapped, the bottom mesh B for the basket is automatically formed; therefore, the basket 10 of the present invention does not need an extra wooden base or metal net. By so doing, the components, the process, and the procedures for assembly are simplified, and it is more convenient to produce and is more cost effective.

The frames 1, 2, 3, can also be flat nets without the respective indentations, and the frames 1, 2, 3, can overlap to form a pad that has bottom mesh B. This structure can be used for decoration for screens using one or more frames 1, 2, 3.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
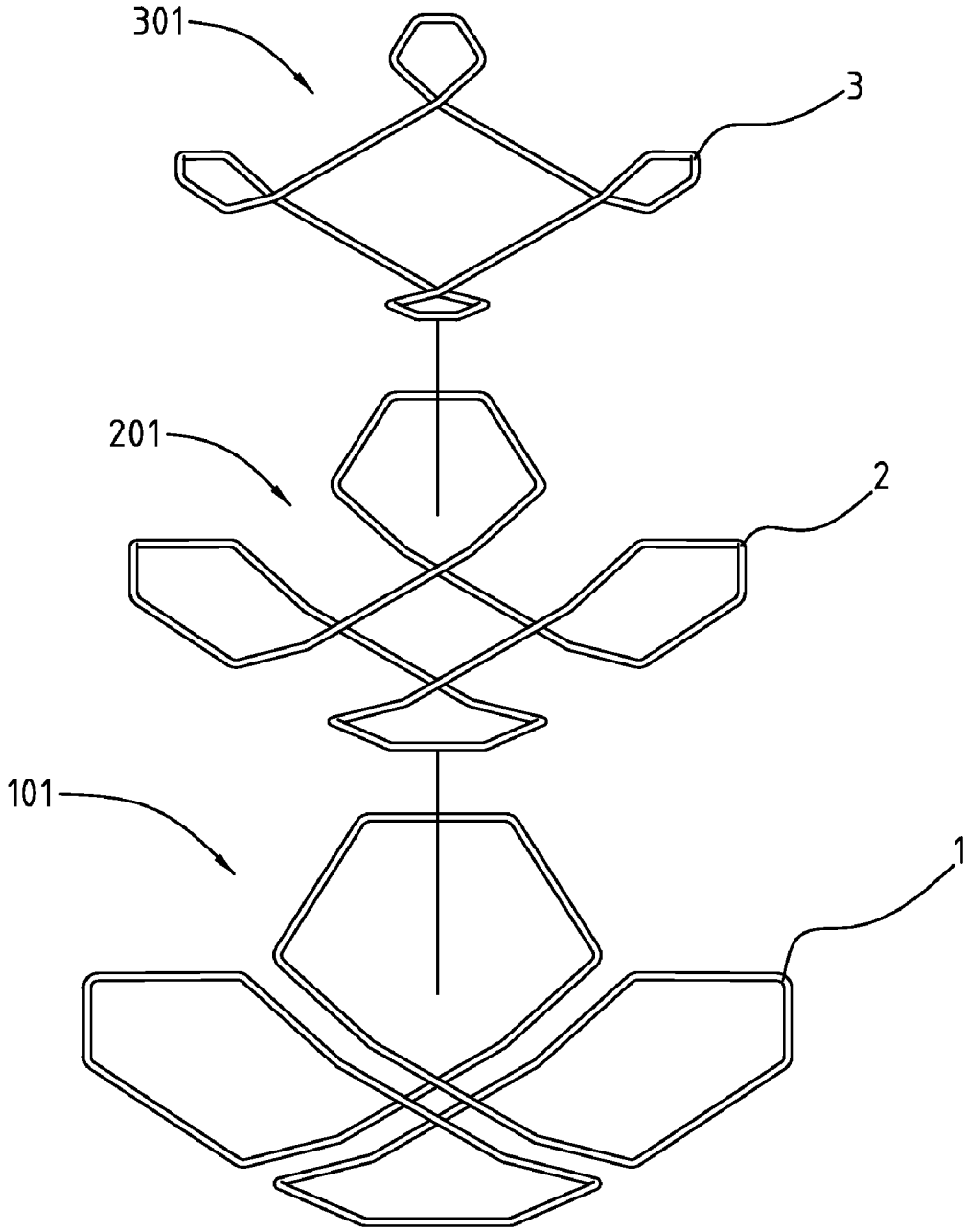
FIG. 1 shows an exploded perspective view of the present invention.
Figure 2:
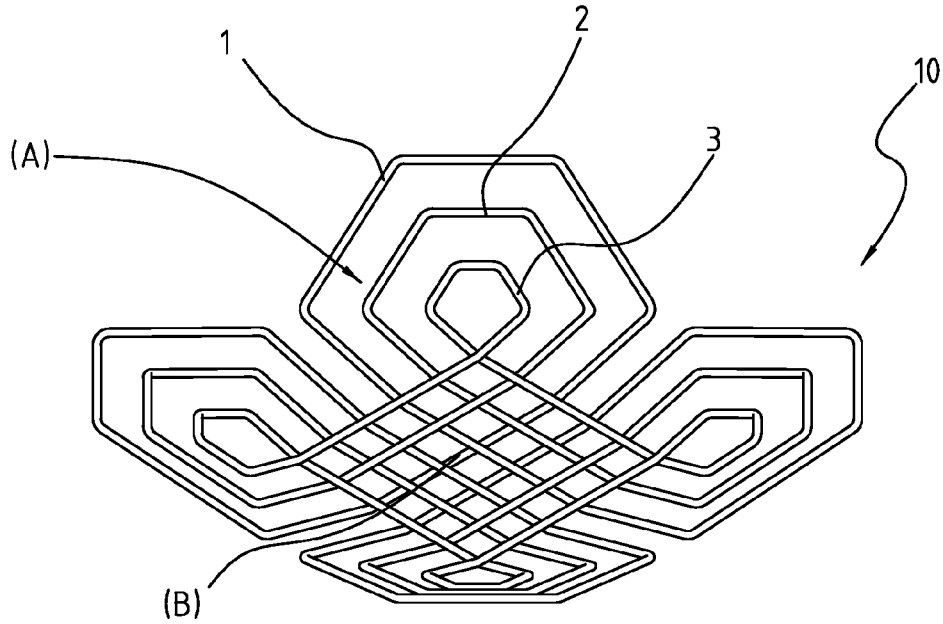
FIG. 2 shows an assembled perspective view of the present invention.
Figure 3:
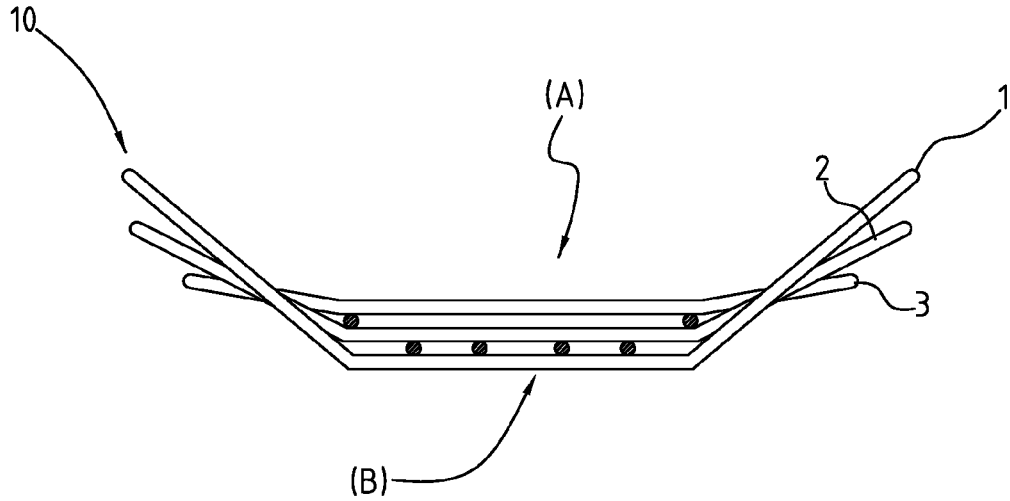
FIG. 3 shows an assembled sectional view of the present invention.
Figure 4:
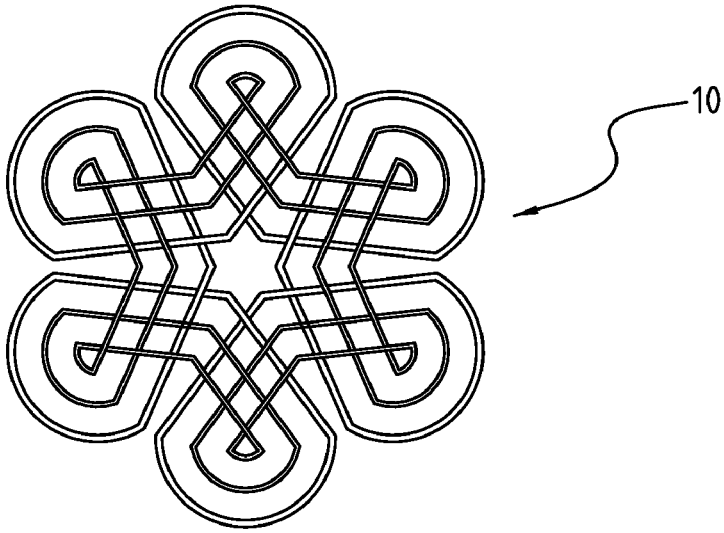
FIG. 4 shows a top plan view of another embodiment of the present invention.
Figure 5:
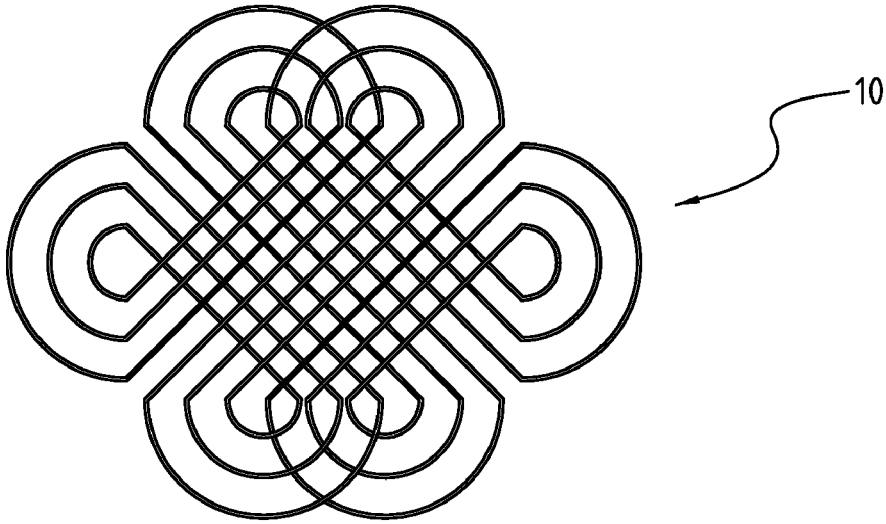
FIG. 5 shows a top plan view of another embodiment of the present invention.
Figure 6:
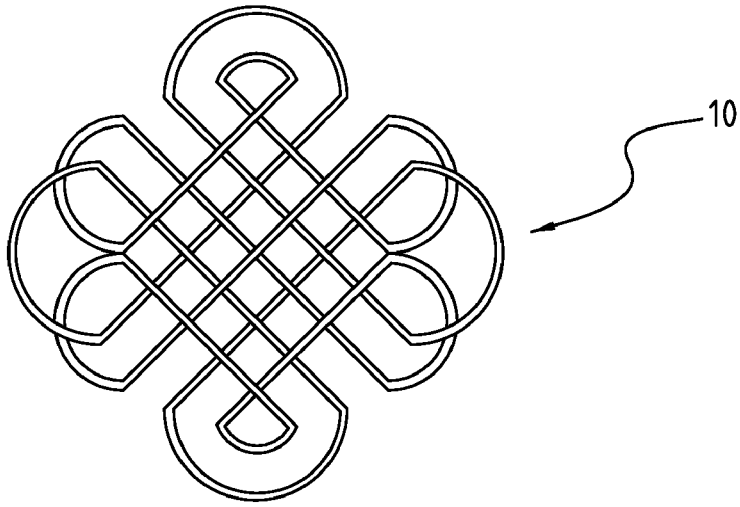
FIG. 6 shows a top plan view of another embodiment of the present invention.
Figure 7:
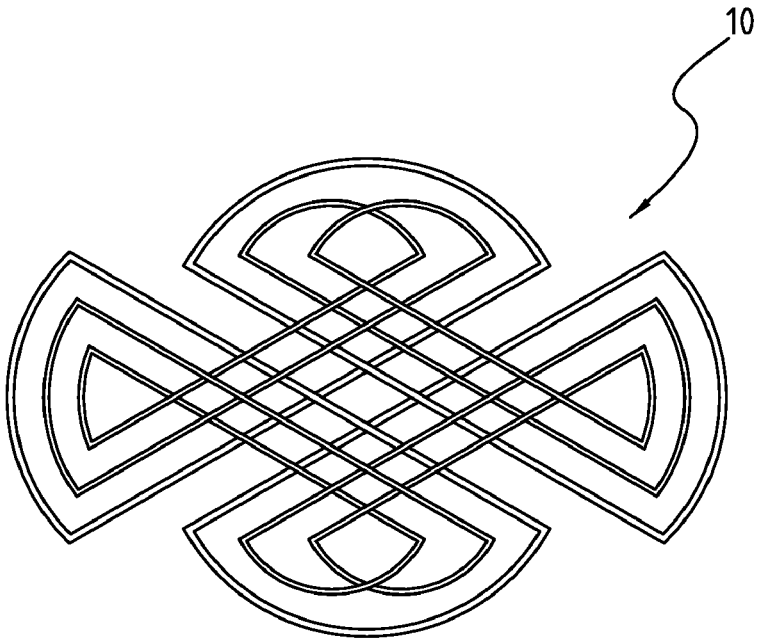
FIG. 7 shows a top plan view of another embodiment of the present invention.

As shown in FIGS. 1, 2, 3, there is the preferred embodiment of the patterned frame structure of the present invention. This embodiment is a basket for descriptive purposes only, with the scope of the invention being determined by the claims.

The patterned frame structure includes one or more frame elements 1, 2, 3. The frame elements 1, 2, 3, are made with wires, having shapes pressed by plates. The top of each frame 1, 2, 3, has an indentation at 101, 201, 301, so that the indentations 1, 2, 3, overlap each other. The frames 1, 2, 3, may have welding connections at the indentations at 101, 201, 301 as the best connection. The frames 1, 2, 3, create a basket 10 that has a bottom mesh B and containment space A.

As shown in FIGS. 4-7, other embodiments with several modifications of the basket 10 are shown. For example, one alternate embodiment of the patterned frame structure of the present invention has frames shaped as flat nets. Each frame still overlaps each other, to that the frames form a pad that has a bottom mesh, which can be used for decoration for screens by single or multiple frames.

I claim:

1. A patterned frame structure comprising:

a first wire frame element having a central area and a plurality of petal-shaped portions extending upwardly from said central area, said central area defined by a first wire perimeter, each of said plurality of petal-shaped portion defined by a first wire shape;

a second wire frame element having a central area and a plurality of petal-shaped portions extending from said central area, said central area of said second wire frame element defined by a second wire perimeter, each of said plurality of petal-shaped portions of said second wire frame element defined by a second wire shape; and a third wire frame element having a central area and a plurality of petal-shaped portions extending from said central area, said central area of said third wire frame element defined by a third wire perimeter, each of said plurality of petal-shaped portions of said third wire frame defined by a third wire shape, the wires of each of said first, second and third wire frame elements overlapping each other, said first wire perimeter having an area less than an area of said second wire perimeter, said second wire perimeter having an area less than an area of said third wire perimeter, said first wire shape having an area greater than an area of said second wire shape, said second wire shape having an area greater than an area of said third wire shape.

* * * * *